US005810057A

United States Patent [19]

Westman

[11] Patent Number: 5,810,057

[45] Date of Patent: Sep. 22, 1998

[54] PRESSURE VESSEL FILL PROTECTIVE DEVICE

[75] Inventor: Martin Alfred Westman, Allentown, Pa.

[73] Assignee: Air Products and Chemicals, Inc., Allentown, Pa.

[21] Appl. No.: 550,140

[22] Filed: Oct. 30, 1995

[51] Int. Cl.[6] ..... B65B 1/04

[52] U.S. Cl. ..... 141/46; 141/50; 141/198; 137/71; 137/68.19; 137/461

[58] Field of Search ..... 141/46, 50, 95, 141/197, 198, 227; 137/68.11, 68.19, 71, 461

[56] References Cited

U.S. PATENT DOCUMENTS

| | | | |
|---|---|---|---|
| 3,476,133 | 11/1969 | Stedfeld | 137/461 |
| 3,930,517 | 1/1976 | Gagala | 137/71 |
| 4,522,227 | 6/1985 | Mylander | 141/198 |
| 4,913,184 | 4/1990 | Fallon | 137/68.19 |

*Primary Examiner*—Henry J. Recla
*Assistant Examiner*—Steven O. Douglas
*Attorney, Agent, or Firm*—James C. Simmons

[57] ABSTRACT

A method and apparatus for preventing over-pressurization of vessel during filling with a fluid where temperature of the vessel would cause the fluid to flash or rapidly expand on contact. A shut off device is placed in a conduit between the fluid source and the vessel being filled, the shut off device including a flow control piston that is held in position to permit fluid flow. Fluid pressure from the displacement space in the vessel is provided on both end of the piston. When a condition of over-pressurization occurs in the vessel a rupture disc associated with one end of the piston fails and causes a depressurization on that end of the piston causing it to move to a position where further filling of the vessel is prevented. The piston is positioned by a buckling pin and can be reset after over-pressurization of the vessel is connected and filling can resume.

7 Claims, 3 Drawing Sheets

PRESSURE VESSEL FILL PROTECTIVE DEVICE

FIELD OF THE INVENTION

The present invention pertains to devices to terminate filling of a pressure vessel with a liquid due to a sudden large increase of internal pressure in the vessel caused by vaporization of the liquid inside the vessel.

BACKGROUND OF THE INVENTION

Pressure vessels, e.g. tanks, are used in various industrial processes for storing fluids for use in the process. One example of such a vessel is a cryogenic storage tank used to contain liquid oxygen, nitrogen or argon which is subsequently withdrawn from the tank on demand, vaporized and used in industrial processes from food preparation and packaging to the manufacture of metals and the treatment thereof. Cryogenic storage tanks or vessels are usually vacuum jacketed structures containing an inner storage vessel surrounded by an outer pressure vessel. The space between the inner and outer vessels can contain insulation and is generally maintained under vacuum.

One problem in the use of large cryogenic storage tanks or vessels is that as the cryogenic liquid is withdrawn from the tank, the tank can become warm to the point where, when the tank is empty, if cryogenic fluid is introduced into the vessel, the cryogenic fluid will immediately flash to vapor and cause an over-pressurization of the vessel. Unless filling of the vessel is terminated, there can be a cataclysmic failure of the vessel. This has long been recognized as a hazard in the replenishment of cryogenic fluid in what are called customer stations or tanks that are located on a customer facility and are filled by a merchant cryogenic supplier.

In particular, in the case of liquid oxygen nitrogen or argon, customer stations can be as large as 50,000 gallons. As the customer withdraws the liquid cryogen from the vessel, the vessel can begin to warm. When a tank is in the warm condition, that is, where the inner vessel temperature has risen significantly beyond the range at which liquid cryogen can be stored in the liquid condition, if additional liquid cryogen is introduced into the inner vessel during a fill operation and there are no safeguards, the liquid cryogen would immediately flash upon contact with the wall of the inner vessel causing an extremely rapid pressure rise so that safety relief devices, normally associated with such tanks, acting simultaneously would not be able to handle the required relief of the vaporized cryogen. This could result in cataclysmic failure of the vessel if the introduction of liquid cryogen into the inner vessel can not immediately be terminated.

SUMMARY OF THE INVENTION

The present invention pertains to a method and apparatus for preventing over-pressurization of a vessel during filling with a fluid where the temperature of the vessel would cause the fluid to flash or rapidly expand on contact with the inner surface of the vessel. In accord with the invention, a shut-off device is placed in a conduit between the source of fluid and the vessel being filled. The shut-off device contains a piston which in the normal operating condition permits fluid to flow through the shut-off device and a passage in the piston which is aligned with a conduit connected to the source of fluid and another conduit connected to the interior of the vessel being filled. The vapor space above the liquid being introduced into the vessel is connected to a displacement space above the piston and to a passage communicating with the bottom of the piston. The piston is normally positioned using a buckling pin disposed between the top of the housing of the device and the top of the piston in a displacement space above the top of the piston. A rupture disc is placed in the conduit connected to the vapor space above the piston that in turn is connected to the vapor space of the tank. The rupture disc is set to the burst pressure of the main rupture discs normally associated with the pressure vessel. In the event the vapor pressure inside the vapor space of the tank rises to the level at which the tanks main rupture disc would fail, the rupture disc associated with the device of the present invention fails thus almost immediately depressurizing the displacement space above the piston. Such depressurization causes the piston to rise moving the passage in the piston away from the conduits and thus closing off the flow of fluid from the filling device to the tank. As the piston moves the buckling pin fails thus permitting the shut-off device to work. When conditions of over-pressurization have been remedied, the piston can be manually repositioned to once again permit fluid to flow into the tank.

DETAILED DESCRIPTION OF THE INVENTION

Figure 1:
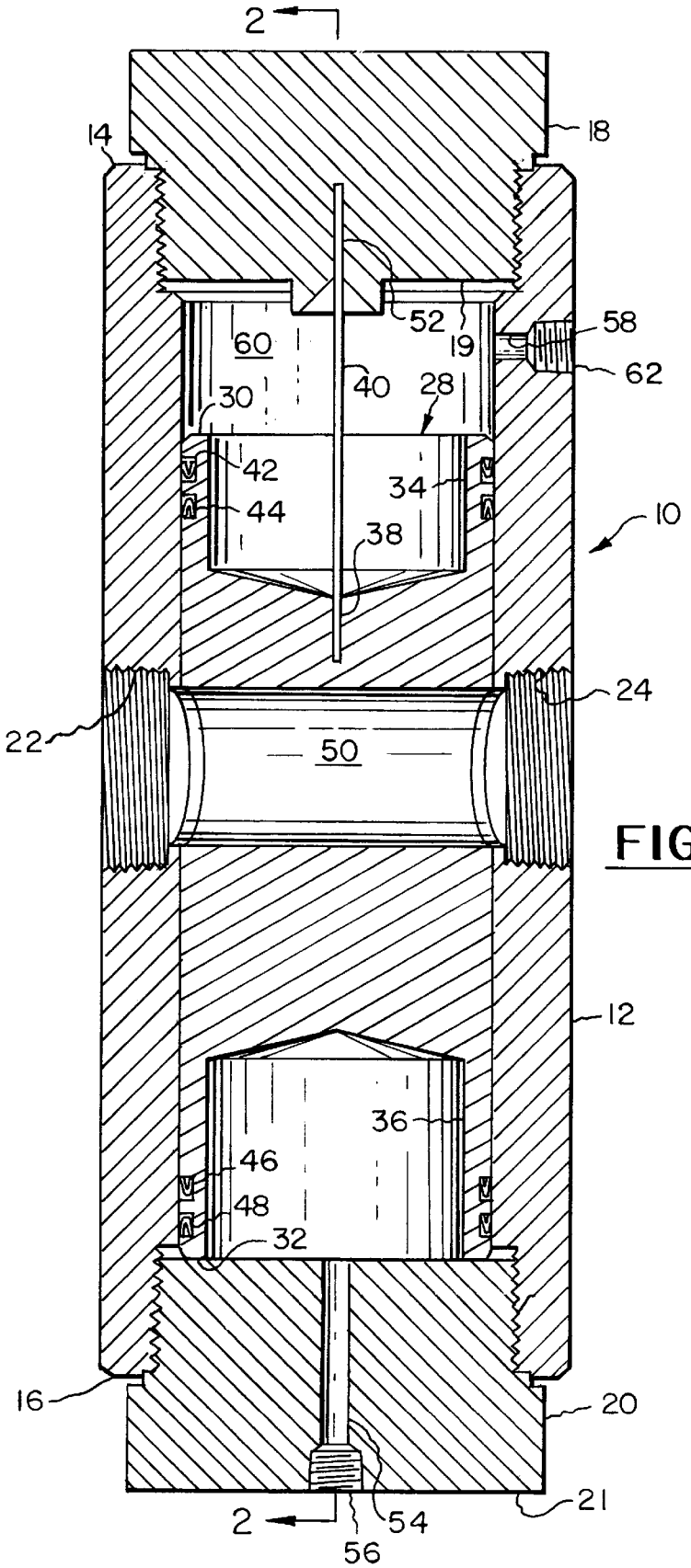
FIG. 1 is a vertical section through a protective device according to the present invention.

FIG. 1 shows a protective device 10 according to the present invention. Device 10 includes a generally hollow cylindrical body 12 having a threaded first end 14 and a threaded second end 16 adapted to receive complimentary threaded caps 18 and 20 respectively. Body 12 includes diametrically opposed ports 22 and 24 threaded to receive conduits normally associated with filling a pressure vessel as will hereinafter be more fully explained.

Disposed within body 12 is a generally cylindrical piston 28 having a first-end 30 and a second end 32. Piston 28 contains complimentary counter bores 34 and 36 on the first end 30 and the second end 32 respectively. Counter bore 34 includes a central aperture at the bottom 38 to receive a buckling pin 40 as will hereinafter be more fully explained. Piston 28 includes circumferential seals 42, 44 proximate the first end 30 and circumferential seals 46, 48 proximate second end 32. Piston 28 includes a central transverse passage 50 which is aligned with the ports 24 and 26 respectively when the piston is at the bottom of the housing 12 as shown in FIG. 1.

Buckling pin 40 extends from the aperture 38 in the first end 30 of piston 28 to a slot or aperture 52 in top cap 18 so that the piston 28 can be held in the position shown when the device is assembled. Bottom cap 20 includes a central gas passage 54 which communicates with the counter bore 36 of piston 28. Passage 54 terminates at the outer or bottom surface 21 of cap 20 in a suitable threaded aperture 56. A passage 58 extends through the wall of body 12 to communicate with the upper displacement space 60 which is between the top end 30 of piston 38 and the bottom 19 of cap 18. Passage 58 terminates in a suitably threaded connection 62. Instead of using buckling pin 40 as the means to position piston 28, one could use a spring.

Figure 2:
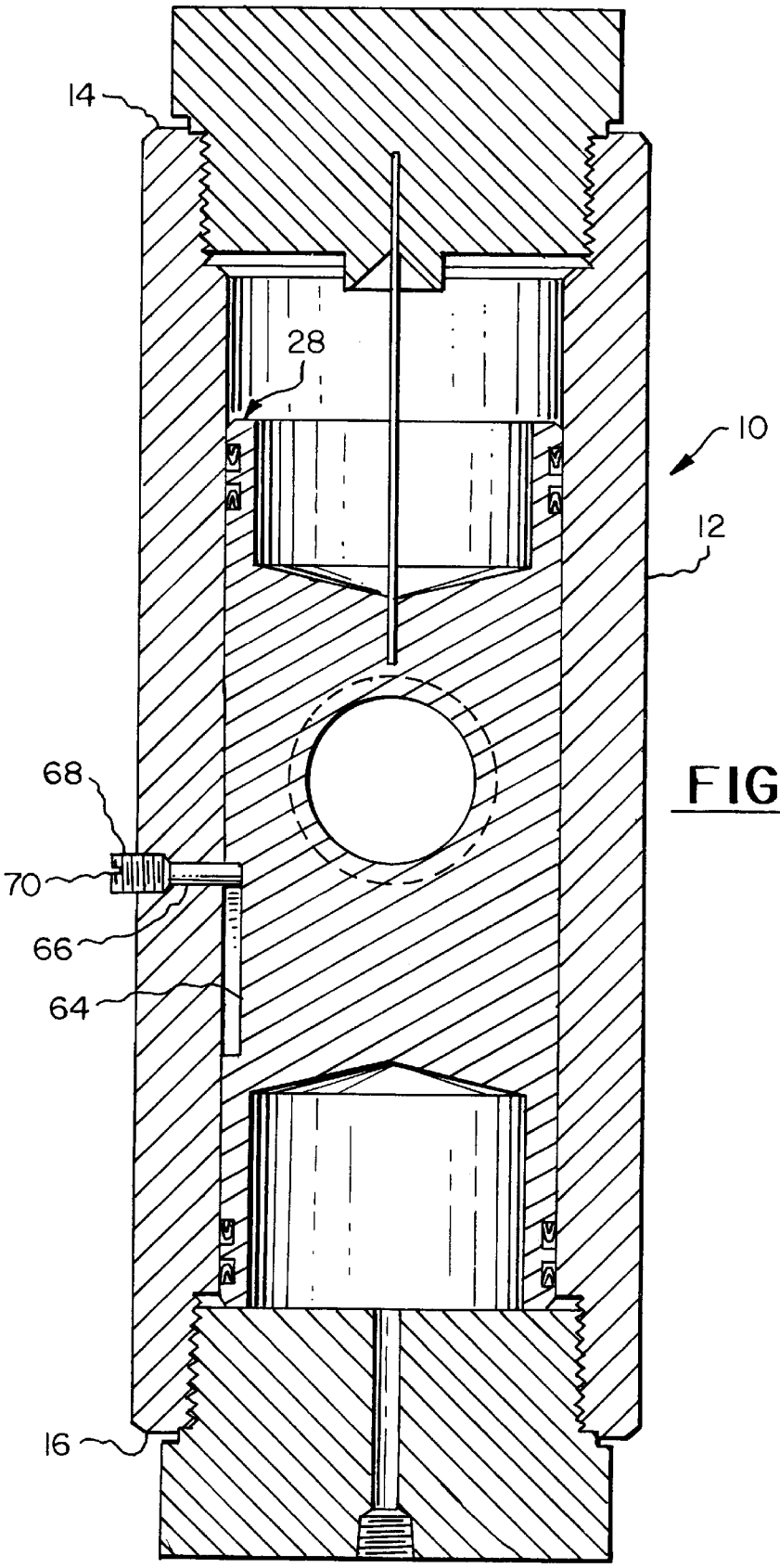
FIG. 2 is a view taken along lines 2—2 of FIG. 1.

Referring to FIG. 2 a guide slot 64 is machined in the bottom half of piston 28 of protective device 10. Disposed in the body 12 is a locating pin, aperture 66 which is in the form of stepped cylinder, the larger cylindrical portion having suitable threads. A guide pin 68 in the form of a stepped cylinder complimentary in shape to the aperture 66 can be placed into the wall of the housing 12 to contact the slot 64 by means of a slotted aperture 70 and a screw driver (not shown). The purpose of the guide pin is to prevent rotation of the piston 28 as it moves in the housing 12.

Figure 3:
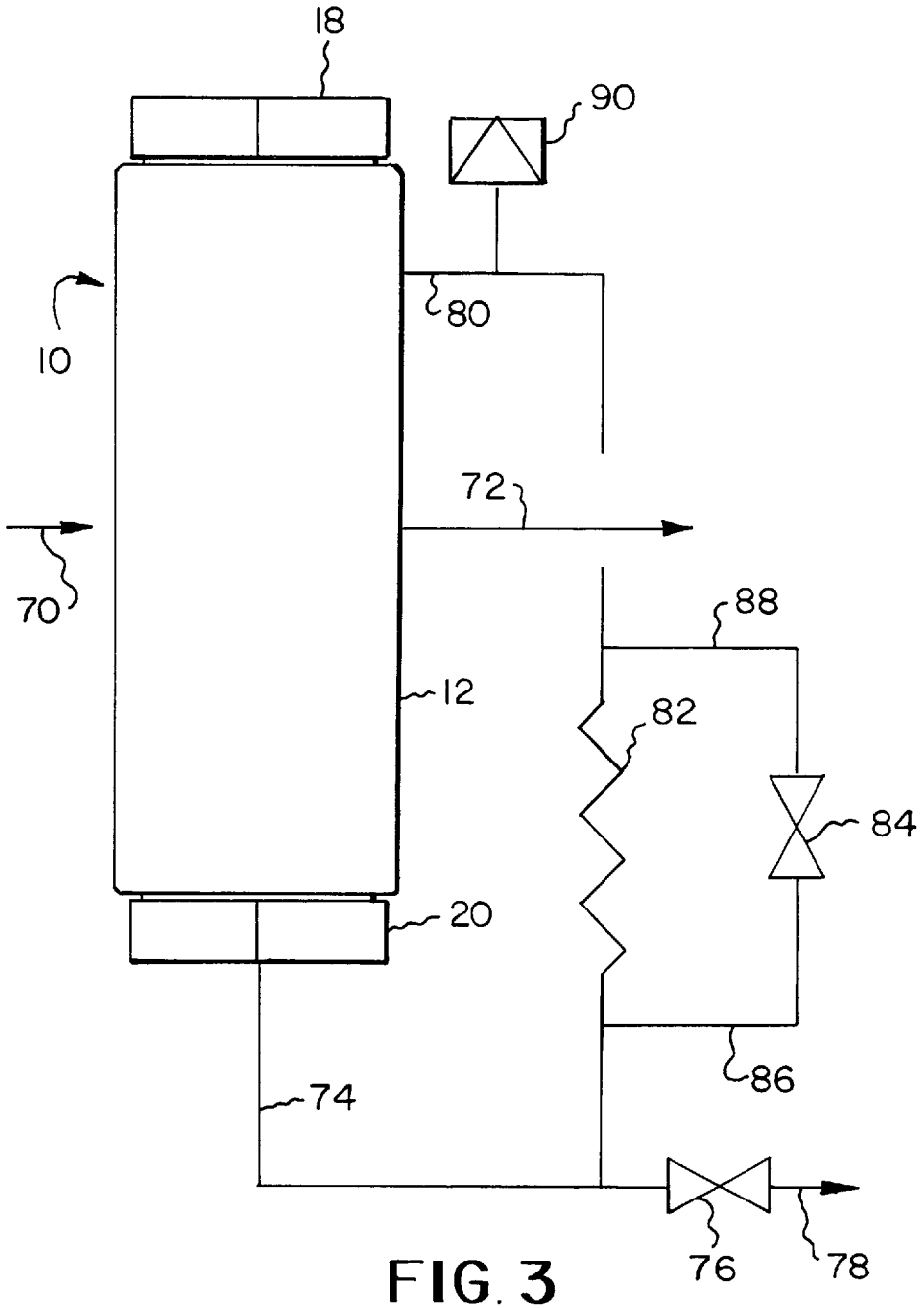
FIG. 3 is a schematic diagram of the device of FIGS. 1 and 2 incorporated into a pressure vessel fill protective system according to the present invention.

FIG. 3 shows an arrangement for installing the protective device 10 into a system used for filling a storage vessel such as a vacuum jacketed cryogenic storage vessel for storing liquid oxygen, nitrogen, argon or the like. A conduit represented by arrow 70 is fixed to the aperture (port) 22 and extends to the source of liquid cryogen (not shown). If the protective device 10 is installed on a customer station conduit 70 would be connected to a trailer hauled to the customers location, the trailer being filled with the liquid cryogen. A conduit represented by arrow 72 is connected to the port 24 and to the storage vessel (customer station) to be filled. A conduit 74 is fixed to the threaded aperture 56 and extends from aperture 56 to a normally open shutoff valve 76 which in turn is connected to the vapor space of the tank via a conduit represented by arrow 78. Conduit 80 is connected to aperture 62 and conduit 74 through a pressure drop or flow restricting device shown generally as 82 as is well known to a worker skilled in the art. A normally closed and locked valve 84 is connected to a series of conduits 86 and 88 to bypass the flow restricting device. A rupture disc 90 is disposed in conduit 80. Rupture disc 90 is set to actuate at the same pressure as the burst pressure discs contained in the customer station.

In operation the device 10 is connected as shown in FIG. 3. Conduit 78 is connected to the vapor space of the tank being filled and valve 76 is in the locked open position and valve 84 is in the locked closed position. The piston is at the bottom of the body 12 so that when cryogen is flowing through conduit 70 it will flow through the device 10 into conduit 72 and into the tank to be filled. In the event the tank being filled is in the warm condition and the cryogen striking the inner vessel vaporizes upon contact and the pressure of the vessel rises to the point where the rupture disc 90 actuates, the space above the top end 30 of piston 22 will immediately be depressurized causing the higher pressure at the bottom 32 of piston 28 to cause the piston to move toward the top cap 18 thus shutting off fluid flow from the fill trailer to the customer station. When the over-pressurized condition is resolved by venting the tank and pre-cooling the inner vessel, the protective device 10 can be reset so that liquid cryogen can be introduced into the tank or customer station. In order to accomplish this, the normally locked open valve 76 is closed and the rupture disc 90 replaced. The top cap 18 can be removed from the body 12 and the piston 28 returned to its position as shown in FIGS. 1 and 2. The buckling pin 40 can be replaced and the top cap 18 replaced thus aligning the passage 50 with the ports 22 and 24. The normally closed and locked valve 84 and the normally locked open valve 76 are opened slowly to provide means to bypass the pressure or flow restrictor 82 and to equalize the pressure in the system and protective device 10 during the resetting operation.

When the device 10 is reinstalled into the cryogenic fill system, and the conduits 70 and 72 are in place, normally locked open valve 76 is opened. When the pressure is equalized between the top and bottom of the piston, the normally closed and locked valve can then be closed and locked and cryogen introduced into the inner vessel of the customer station until it is filled.

As long as the tank pressure does not exceed the relief pressure, pressure in the top and bottom of the piston is balanced and the piston remains in the fluid flow position.

A device according to the invention can be designed to actuate at 1.5 times the maximum allowable working pressure of the inner vessel of the customer station with a plus or minus 5% deviation which corresponds to the burst pressure of the tanks main rupture disc. A device according to the invention has been shown to actuate within three seconds to completely close off cryogenic liquid flow to the customer station after complete actuation.

The body 12 end caps 18, 20 and piston 28 can be manufactured from brass and the buckling pin 40 from a copper or copper alloy as is well known in manufacturing devices for cryogenic service.

According to the invention over-pressurization in the vapor space of a tank to be protected causes a sequence of relatively few events to occur leading to rapid termination of liquid entering the vessel. The mechanical arrangement of the structural elements of the invention are highly reliable in design and function.

Having thus described my invention, what is desired is to be secured by Letters Patent of the United States is set forth in the appended claims.

What is claimed:

1. A device for preventing over-pressurization of a vessel during filling with a fluid should the temperature of the vessel cause the fluid to flash or rapidly expand comprising in combination:

a generally cylindrical housing having a first end and a second end closed by removable caps;

a piston disposed inside said housing said piston having a length less than that of an internal complementary passage defined by said cylindrical housing, said piston normally positioned with a first end juxtaposed to said cap on said first end of said housing and defining a displacement space between a second end of said piston and a cap on said second end of said housing;

a fluid passage through said piston, said passage disposed perpendicular to an axis of movement of said piston;

diametrically opposed inlet and outlet ports in said cylindrical housing, said inlet and outlet ports being of the same diameter and aligned with said passage in said piston when said piston is juxtaposed to said first end of said housing;

means extending in the displacement space between said cap on said second end of said housing and a second end of said piston to position said piston so that said inlet and outlet parts and said passage are in alignment when said device is installed with its inlet port connected to a source of fluid and its outlet port connected to said vessel to be filled;

means to introduce fluid from a vapor space in said vessel to said displacement space and at said first end of said piston to permit fluid to enter said vessel; and means to vent fluid from said displacement space upon over-pressurization of said vessel resulting in an increase of fluid pressure at said first end of said piston; whereby said piston moves from said first end toward said second end of said housing closing said inlet and outlet ports of said housing.

2. A device according to claim 1 wherein said means extending between said cap on said second end of said housing and a second end of said piston to position said piston is a buckling pin.

3. A device according to claim 2 wherein said buckling pin is made of copper or copper alloy.

4. A device according to claim 1 adapted to use with said vessel wherein said inlet in said housing is connected to a source of fluid and said outlet in said housing is connected to a fluid fill inlet on said vessel.

5. A device according to claim 1 adapted to use with said vessel wherein said first end of said housing and said second end of said housing are connected via conduits to a displacement space in said vessel.

6. A device according to claim 5 adapted to use with said vessel including a rupture disc on a conduit connected between said displacement space in said vessel and said second end of said housing.

7. A method for preventing over-pressurization of a vessel during filling with a fluid should the temperature of the vessel cause the fluid to flash or rapidly expand comprising the steps of:

interposing a control device of the type that normally permits fluid to flow from a source of fluid to fill said vessel and said vessel and is responsive to terminate fluid flow when a large increase in pressure is detected in a vapor space in said vessel, between a source of fluid to fill said vessel and said vessel;

maintaining said control device in a position to permit fluid to flow into said vessel by introducing pressure in a displacement space in said vessel to either end of a piston in said control device;

causing said piston to close said fluid path between said source of fluid and said vessel when a condition of over-pressurization occurs in said vessels wherein said step of causing said piston to close said fluid path is effected by releasing pressure on an end of said piston having a displacement space and wherein said fluid flow can be established through said control device by manually resetting said piston.

* * * * *